United States Patent [19]

Simmons

[11] Patent Number: 4,858,927

[45] Date of Patent: Aug. 22, 1989

[54] DARTS HAVING AN ANTI-DEFLECTION APPARATUS

[76] Inventor: Daniel M. Simmons, 427 Seaman Ave., Akron, Ohio 44305

[21] Appl. No.: 159,322

[22] Filed: Feb. 23, 1988

[51] Int. Cl.[4] ..... A63B 65/02

[52] U.S. Cl. ..... 273/416

[58] Field of Search ..... 273/416, 419–420, 273/423; 248/583, 596

[56] References Cited

U.S. PATENT DOCUMENTS

| | | | |
|---|---|---|---|
| 1,681,026 | 8/1928 | Bradnack | 248/583 |
| 1,755,228 | 4/1930 | Stoll | 248/596 X |
| 2,634,069 | 4/1953 | Drake et ak, | 248/583 |
| 3,945,642 | 3/1976 | Henthorn, Jr. | 273/420 |
| 4,675,683 | 6/1987 | Robinson et al. | 273/416 X |

FOREIGN PATENT DOCUMENTS

| | | | |
|---|---|---|---|
| 1508075 | 4/1978 | United Kingdom | 273/423 |
| 1534391 | 12/1978 | United Kingdom | 273/416 |
| 2102296 | 2/1983 | United Kingdom | 273/416 |
| 2153693 | 8/1985 | United Kingdom | 273/423 |

*Primary Examiner*—Paul E. Shapiro

*Attorney, Agent, or Firm*—Oldham & Oldham Co.

[57] ABSTRACT

A dart is provided with a pivotable flight assembly relative to the main dart body. The coupling between the flight and main body portions of the dart comprises a subassembly including a centering piston and bearing being spring-biased in a housing. The centering piston extends from the housing of the subassembly and connects to the flight assembly. The flight assembly is then pivotable with the centering piston acting on the bearing to reduce deflection of subsequently thrown darts.

14 Claims, 4 Drawing Sheets

DARTS HAVING AN ANTI-DEFLECTION APPARATUS

BACKGROUND OF THE INVENTION

This invention relates to darts such as those used in games of skill, and more particularly to darts which employ an anti-deflection apparatus.

The game of darts is played throughout the world as a competitive sport and simply a leisure time activity. The game of darts is normally played with a set of three darts, which are intended to be thrown against a target, and scoring is achieved from the placement of the thrown darts on the target. A very proficient player can throw a number of darts into an area as little as one-quarter of an inch square, which is the type of accuracy required to obtain the highest scores. The small target area in which the throws are desired to be placed creates a problem to the player throwing subsequent darts. The flights, which correspond to feathers on an arrow, of a dart embedded into the target occupy a substantial cross-sectional area in the flight path of subsequent darts. Such flights can pose a substantial obstacle to place a number of darts into a small area on the target.

It has been found that subsequently thrown darts may strike a dart already embedded in the target and be deflected to another area of the target or in such a way that the dart falls to the ground. This gives rise to a substantial obstruction to obtaining the high scores necessary in competition.

Attempts have been made to solve this problem by constructing the darts in special ways. One invention, as shown in U.S. Pat. No. 4,109,915 to Bottelsen, which shows the dart provided with a body that breaks away from the point upon impact or alternatively flights that break away from the body upon impact. It is the objective of this invention to minimize the size of the embedded dart in the target so that subsequently thrown darts may be embedded in the same small area. The breakaway feature of this invention is provided by relative movement upon impact between the point and body to break a magnetic hold between the two. Alternatively, a shaft is provided connected between the point and the flight portion of the dart, wherein upon impact movement of the point into the body of the dart will push the flights away from the dart and provide the breakaway feature. This invention shows a relatively complex mechanism which includes specially adapted points and flights along with a specially constructed body to provide the features thereof.

Another invention which attempts to avoid the problems mentioned above is shown in published English patent specification No. 1,534,391 to Drake et al. In this invention, there is provided a dart including a barrel, a stem for carrying the flight, and a flexible member connecting the two parts. The flexible member is a coil spring mounted on spigots or housed partially within the dart stem and enabling lateral movement of the stem relative to the barrel. This concept proposes an "add-on shaft" that limits the darter to the use of this shaft. The shaft is an important part of the darters ability to accurately control the balance and speed of the dart when throwing. Once the darter becomes accustom with a shaft, they find it difficult to adjust their throw using another shaft. The spring used in this invention is also prone to damage by excessive lateral movement of the stem relative to the barrel from external forces. Such damage will result in untrue flight of the dart and decreased accuracy. The "add-on shaft" proposed in this invention has a low life expectancy, which once it is damaged, must be completely replaced.

It is apparent that problems still exist with these structures to provide a dart which enables a thrower to place a number of darts into a small area on the target. Therefore, it has been found to be desirable to provide an anti-deflection apparatus with the darts to obviate the obstacle presented to subsequently thrown darts by the flights of darts embedded in the target, but in a simplified, reliable, and cost-effective manner.

SUMMARY OF THE INVENTION

It is a general object of the present invention to provide a dart which at least substantially overcomes the aforementioned disadvantages.

It is a further object of the present invention to provide a dart having anti-deflection means enabling lateral movement of portions of the dart relative to one another to avoid deflection by the dart of a subsequently thrown dart.

Another object of the present invention is to provide anti-deflection means wherein no excessive forces can be applied to damage the anti-deflection means.

It is a further object of the present invention to provide anti-deflection means which may be incorporated with standard body and shaft portions to allow a darter to use a shaft that they have become familiar with.

According to the present invention, there is provided a dart including separable portions comprising an elongated main body portion having a point to be embedded in the target extending therefrom, along with a shaft portion for retaining a flight. A subassembly is interposed between the main body portion and the shaft portion which enables lateral movement of the shaft relative to the main body portion. The subassembly provides an anti-deflection means which allows the flight assembly and shaft to move out of the way when struck by another dart. This action will increase the chance of the dart reaching its designated target, and may be used with existing body and shaft portions. In the preferred embodiment, the subassembly includes a housing having a longitudinal bore therein which is coupled to the main body portion. A compression means acts upon a bearing in the bore to bias the bearing against a centering piston which extends from the housing and is coupled with the shaft portion.

In an alternate embodiment of the present invention, the subassembly includes a housing having a longitudinal bore therein which is coupled to the main body portion as previously described. An extension spring is connected to the main body portion and to a shaft housing connected to the flight assembly. The extension spring acts to seat the shaft housing within a groove formed in the subassembly housing to thereby keep the shaft of the dart centered along its axis.

Both of the constructions descried allow sufficient lateral movement of the shaft portion relative to the main body portion to avoid deflection of subsequently thrown darts. With the anti-deflection apparatus, it has been found that the resulting assembly is significantly improved along with being more cost effective and reliable than previous attempts found in the prior art.

BRIEF DESCRIPTION OF THE DRAWINGS

For an understanding of the scope of the invention and for the complete understanding of the objects, techniques, and structure of the invention, reference should be made to the following detailed description of the accompanying drawings wherein.

DETAILED DESCRIPTION OF THE INVENTION

Figure 1:
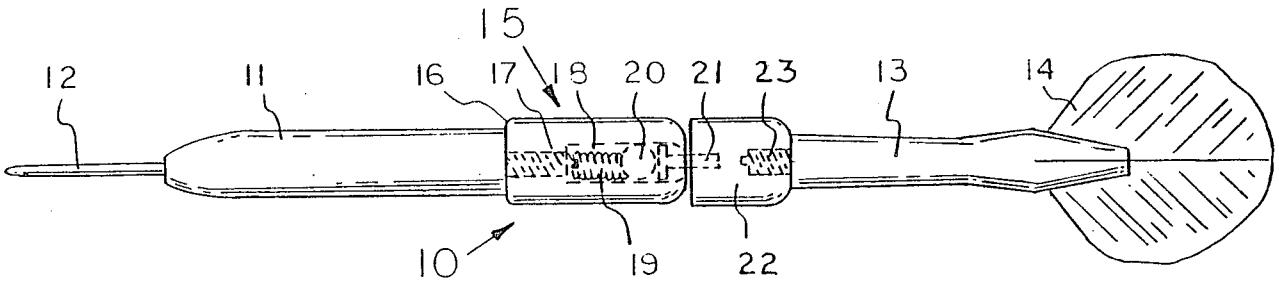
FIG. 1 is a side view of a dart having the anti-deflection apparatus therein.

For a complete understanding of the scope of the preferred embodiments of the invention, reference is made to FIGS. 1–8 showing the preferred embodiments of the present invention. In FIG. 1, the dart 10 is shown having a main body portion 11 with a point 12 protruding therefrom, which will be embedded in the target when the dart is thrown. The dart 10 also includes shaft portion 13 having slots to engage and retain a flight 14. The shaft is an important part of the darter's ability to accurately control the balance and speed of the dart. Both the main body portion 11 and shaft portion 13 may be of any standard construction to enable the darter to utilize the invention with any main body portion and shaft portion which they desire. To couple the main body portion 11 and shaft portion 13, there is provided a subassembly 15 comprising the anti-deflection means of the present invention. The subassembly 15 comprises a housing 16 having means 17 to engage the main body portion 11 of the dart. The means 17 may be a threaded projection integral with the main portion 11 and threadably engagable with the housing 16. Alternatively, the means 17 may be a threaded plug which coacts with both the housing 16 and a threaded recess in the main body portion 11 of the dart 10. A longitudinal bore 18 is provided in the housing 16 in which a force applying means such as a compression spring 19 is housed. Also disposed in the longitudinal bore 18 is a bearing means 20 comprising a steel ball, or the like, and centering piston 21, both biased in the bore 18 by the compression means 19. It is a special feature of the invention that the compression means 19 and bearing are housed wholly within the bore 18 of the housing 16. By this construction, no excessive forces can be applied to the compression means 19 to thereby damage it.

From this internal design, the life expectancy of the anti-deflection means will be extended to eliminate the need to replace the anti-deflection components. The centering piston 21 is seen to extend from the bore 18 of the housing 16, and then is connected to a shaft hosing 22 having means 23 to engage the shaft portion 13. It can be seen that the centering piston 21 is biased within the bore 18 towards the shaft portion 13 to thereby center the shaft portion 13 along the axis of the dart 10, and also prevent unwanted motion of the shaft potion 13 during a darter's throw. It is also an important aspect of the present invention that the compression means 19 is suitably constricted between a means to engage the main body 17 and the ball 20 to provide the appropriate force necessary to prevent unwanted motion of the shaft portion 13, but still allow the anti-deflection movement. The force necessary is in the range of 40 to 100 lbs. of pressure applied to the bearing means 20 in order to keep the shaft portion aligned via centering piston 21, and still afford anti-deflection.

Another advantage of the anti-deflection means provided in the subassembly 15 is to enable 360 degree lateral and rotational motion of the shaft portion 13 relative to the main body portion 11 of the dart 10. If a subsequently thrown dart strikes the shaft portion 13 of dart 10, the shaft portion 13 will be moved laterally to avoid obstruction to the subsequently thrown dart. By the rotational motion, the flights of the shaft portion may additionally be easily turned to avoid obstruction to subsequently thrown darts. It can be seen that the housing 16 is tapered adjacent to the shaft housing 22 to facilitate lateral movement of the shaft portion 13 relative to the housing 16 and main body portion 11.

Figure 2:
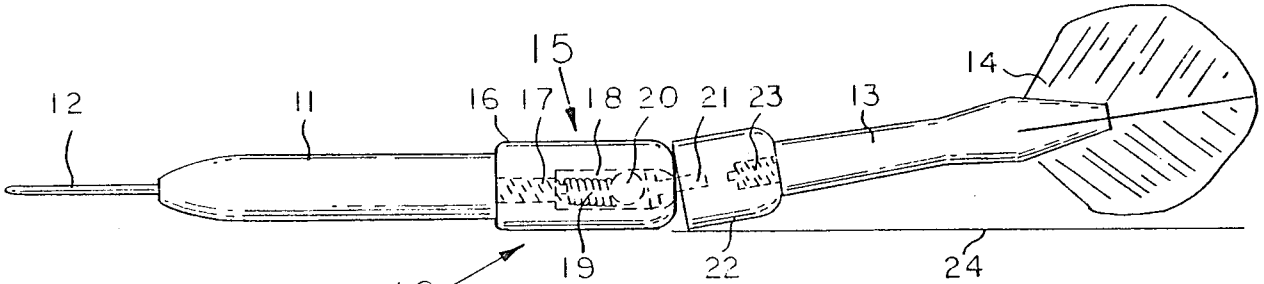
FIG. 2 is a side view of a dart employing an anti-deflection means of the present invention, and showing relative movement of the shaft portion relative to the main body portion.

Turning now to FIG. 2, the operation of the anti-deflection means is more particularly shown. In this figure, the lateral motion of the shaft portion 13 is shown relative to the main body portion 11. It is seen that the shaft portion 13 may be laterally displaced by means of centering piston 21 acting within the bore 18 of the subassembly 15. The compression means 19 acts to bias the bearing against the centering piston to keep the shaft portion 13 along the axis of the dart 10. Upon an external force being applied to the shaft portion 13, it may be moved laterally with centering piston 21 acting against the bearing 20 and compression means 19 within the bore 18. It is noted that the extent of the lateral movement of shaft portion 13 enables complete removal of the obstruction presented by the shaft portion 13 to another dart having a flight parallel to the edge of the dart 10 along line 24. It is also noted that the compression means 19 has sufficient resiliency to enable an external force, such as may be applied by a subsequently thrown dart, so that the shaft portion will not pose any obstruction to the subsequently thrown dart. After such lateral movement, a shaft portion 13 will return to alignment with the axis of the dart 10 by the force of compression means 19 acting on bearing 20 and centering piston 21.

Figure 3:
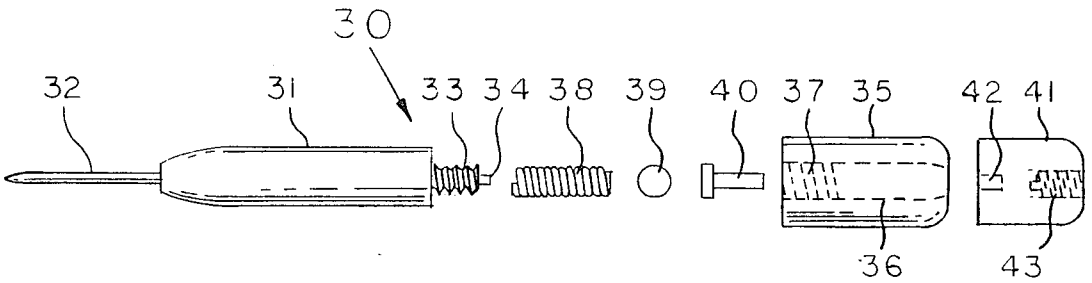
FIG. 3 is an exploded view of the anti-deflection means of the present invention.

The anti-deflection means is shown more particularly in FIG. 3 wherein subassembly 30 is shown in exploded view. The main body portion 31 of a dart has a point 32 and a threaded projection 33 for coupling to the subassembly components. The threaded projection 33 carries a spigot 34 at the end thereof. The spigot 34 is utilized to engage a compression spring 38, to thereby keep the spring centered with the axis of the dart. A bearing or ball 39 is provided, and is acted on by the spring 38 to thereby bias it against the centering piston 40 having a plate portion and shaft. The housing 35 is provided with a longitudinal bore 36, and acts as a retaining cap to house the compression means 38, bearing 39, and centering piston 40. It is noted that the bore 36 is provided with a tapered end in order to retain the plate portion of the centering piston 40. The housing 35 is engaged onto projection 33 to encase the elements described therein. The shaft of centering piston 40 extends out through the bore 36 and may be secured to shaft housing portion 41 in a slot 42. The shaft housing portion 41 also contains a threaded aperture 43 with which a shaft portion may be engaged.

Figure 4:
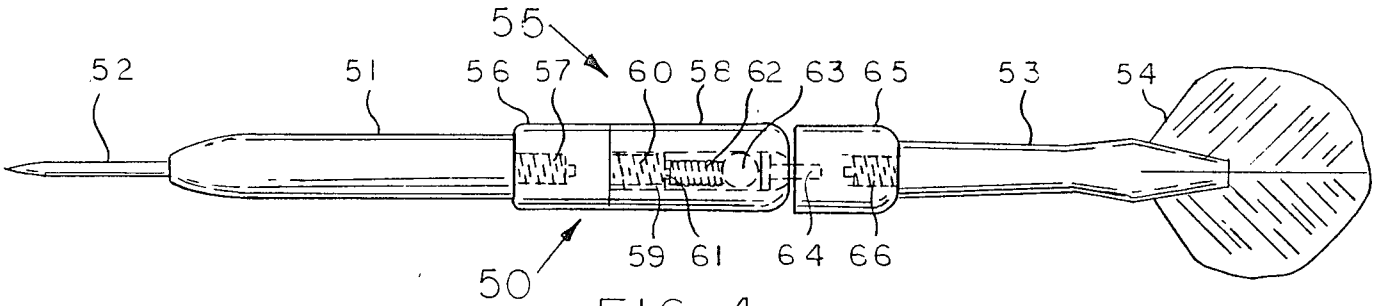
FIG. 4 is a side view of a dart showing an alternate embodiment of the anti-deflection means of the present invention.

An alternate embodiment of the present invention is shown in FIG. 4, wherein the anti-deflection means of the present invention is complete and separable in itself. As shown in FIG. 4, a dart 50 comprises a main body portion 51 having point 52 projecting therefrom, along with shaft portion 53 housing and retaining flight 54. A subassembly 55 is provided having a section 56 adapted to engage the main body portion 51 by means 57. A housing 58 is provided with a longitudinal bore 59 therein. An engaging means 60 extends from section 56 into the bore 59 of housing 58. The engaging means 60 has a spigot 61 projecting therefrom which engages compression means 62 within the bore 59 to thereby keep the compression means 62 centered within the bore 59. Also provided in the bore 59 is a bearing means 63 and centering piston 64 as previously described. The centering piston 64 extends from the housing 58 and is secured to a shaft housing section 65 which is adapted to engage shaft portion 53 by means 66. It can be seen in this embodiment of the invention, that the subassembly 55 may be removed from the main body portion 51 and shaft portion 55 while retaining anti-deflection means therein. The function of the anti-deflection means in FIG. 4 is similar to that previously described in relation to FIG. 1. In this embodiment of the present invention, the correct force necessary to be applied by compression means 62 is accomplished in a preassembled manner. This embodiment also enables a darter to utilize any desired main body and shaft portions to which they may have become familiarized with. It is noted that a threaded plug may also be used to engage the longitudinal bore 59 of housing 58, and further engaging the main body portion 51 of the dart. By either of these constructions, the subassembly may be preassembled and used with any conventional main body and shaft portions.

Figure 5:
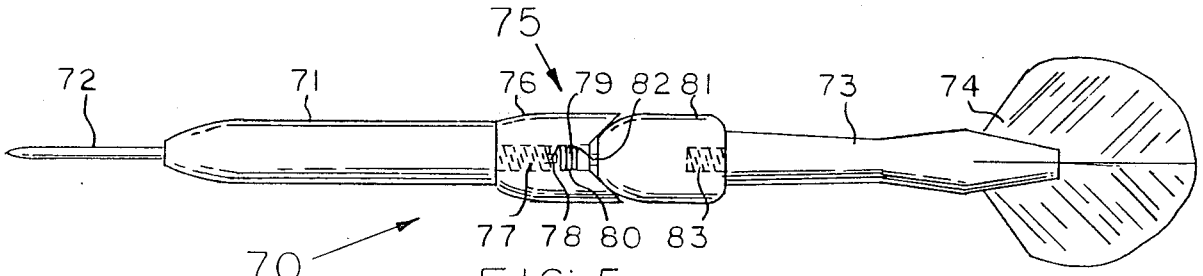
FIG. 5 is a side view of a dart employing an alternate embodiment of the anti-deflection means of the present invention.

A further embodiment of the present invention can be seen with reference to FIG. 5, wherein a dart 70 comprises the main body portion 71 and point 72 along with shaft portion 73 including flight 74. A subassembly 75 couples the main body portion 71 with the shaft portion 73 and includes anti-deflection means therein. The subassembly 75 includes a housing 76 being threadably engagable to main body portion 71 by means 77. The threadably engagable means 77 includes a spigot 78 having an aperture therein. A longitudinal bore 79 is formed by housing 76 and is utilized to retain an extension spring 80 therein. It is noted that the longitudinal bore 79 has at its one end a small aperture to enable coupling to the extension spring 80 within bore 79. A shaft housing 81 coupled to shaft portion 73 by means 83 also comprises a spigot 82 having an aperture therein to which extension spring 80 is coupled outside of the bore 79.

It can be seen in FIG. 5, that the housing 76 comprises a recess at the one end thereof in which shaft housing 81 is seated. The extension spring 80 is coupled to the spigot of means 77 and to spigot 82 on shaft housing 81. In this way, the shaft housing 81 is retained in the recess and centered along the axis of the dart 70 thereby. The extension springs 80 supplies a sufficient force to keep the shaft housing 81 and shaft portion 73 aligned with the axis of the dart when no external forces are applied. If a subsequently thrown dart strikes the shaft portion 73 of dart 70, lateral movement of the shaft portion 73 enabled by the resiliency of extension spring 80 avoids deflection of the subsequently thrown dart. It is noted that the shaft housing 81 is tapered to seat firmly within the recess of housing 76 and facilitate lateral movement if an external force is applied.

Figure 6:
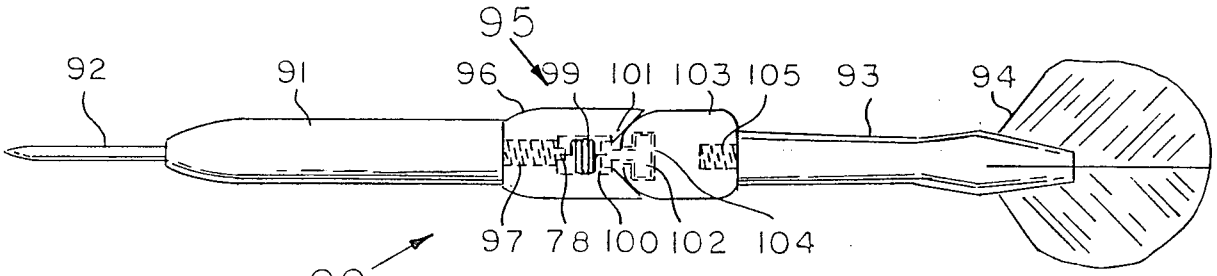
FIG. 6 is a side view of a dart showing an alternate embodiment of the anti-deflection means of the present invention.

An alternate embodiment of the invention as shown in FIG. 5 can be seen with reference to FIG. 6. In this embodiment, a dart 90, comprises main body portion 91 having point 92 and shaft portion 93 carrying flights 94 as previously described. Subassembly 95 comprises a housing 96 similar to that described with reference to FIG. 5 and being coupled by means 97 to main body portion 91. The means 97 includes a spigot 98 having an aperture therein extending within longitudinal bore 99 of housing 96. An extension spring 100 is housed within longitudinal bore 99 and connects to spigot 98 along with a centering means or piston 102. Centering piston 102 has enlarged portions at each end thereof for insertion into a notched aperture 101 within housing 96. By such insertion, centering piston 102 is retained by housing 96 to thereby fully encase the extension spring 100 within the longitudinal bore 99 of housing 96. In this way, no excessive forces may be applied to damage the extension spring 100 of the anti-deflection means. Centering piston 102 is also coupled to shaft housing 103 having an aperture 104 therein. By seating centering piston 102 in the aperture 104, rotation of the shaft portion 93 is enabled along with lateral movement as previously described. In comparison with the embodiments shown in FIG. 5, no damage to the extension spring 100 may result from rotation of shaft portion 93.

Figure 7:
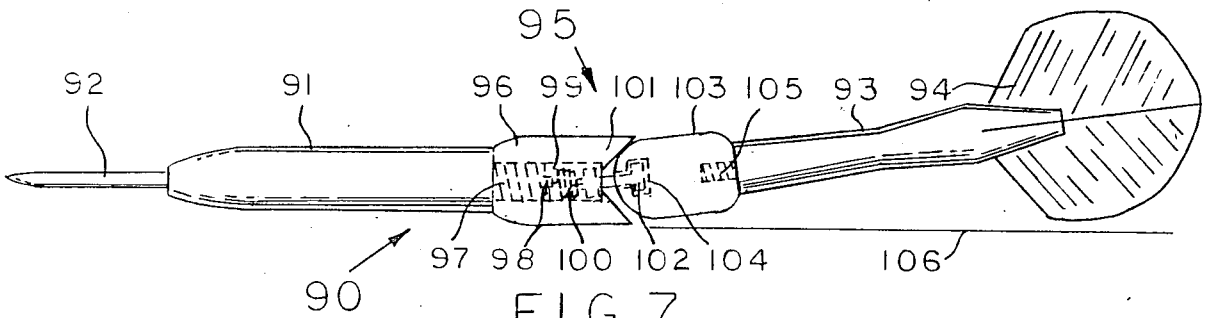
FIG. 7 is a side view of a dart employing the anti-deflection means of the present invention as shown in FIG. 6, and showing relative movement of the shaft portion relative to the main body portion.

With reference to FIG. 7, the operation of the anti-deflection means is seen wherein upon an external force being applied to the shaft portion 93, lateral movement is obtained by the anti-deflection means shown. The lateral movement allowed by the anti-deflection means is sufficient to avoid deflection of a subsequently thrown dart parallel to the main body portion 91 along line 106 as shown. After such an external force is eliminated, the extension spring 100 will act to bring shaft portion 93 back into alignment with the dart axis.

Figure 8:
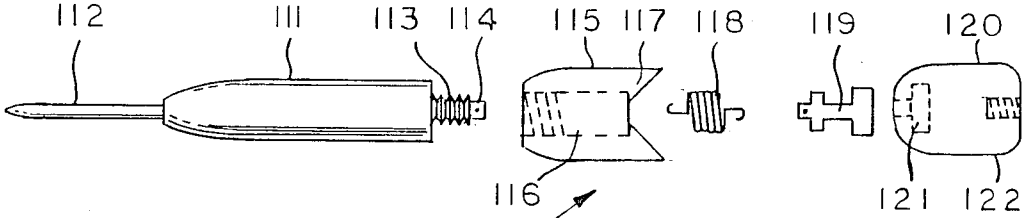
FIG. 8 is an exploded view of the anti-deflection means of the embodiment shown in FIG. 6.

A more detailed view of the anti-deflection means shown in FIGS. 6 and 7 can be seen with reference to FIG. 8. Here the subassembly 110 is coupled to a main body portion 110 having point 112 and threaded projection 113. The threaded projection 113 has a spigot 114 with an aperture therein for coupling to the force applying means. A housing 115 having a longitudinal bore 116 is threadably engagable with projection 113 of main body portion 111. A housing 115 also comprises a notched aperture 117 at one end thereof, and also forms a recess. The extension spring 118 is coupled to a spigot 114, and further engages centering piston 119 to apply a force thereto. The extension spring 118 is fully encased within longitudinal bore 116 of housing 115 to avoid any damage to the spring. The centering piston 119 is inserted into longitudinal bore 116 and retained by notched aperture 117 and centered along the axis of the dart. The centering piston 119 also engages notch 121 of shaft housing 120 to thereby couple the main body 111 and the shaft portion. The shaft housing 120 comprises means 122 to couple to such a shaft portion. It is seen in this embodiment of the invention, the centering piston 119 enables extension spring 118 to be fully housed within housing 115, and also enables rotational movement of shaft housing 120 relative thereto.

From this description it can be easily recognized that the construction of the embodiments shown have distinct advantages to substantially reduce the likelihood of a dart being deflected off another dart already thrown on a target. The flight assembly of the dart may be moved out of the way when struck by another dart thereby increasing the chance of the dart reaching its designated target. The shaft portion or flight assembly may be moved laterally in any direction without damaging the anti-deflection means of the present invention, and also may be rotated relative thereto. The anti-deflection means is located wholly within a housing thereby eliminating damage to its components due to external forces. The anti-deflection means, though allowing lateral movement of the shaft portion of the dart, maintains this portion in alignment with the axis of the dart when no significant external forces are applied, and does not allow unwanted motion of the shaft portion during a darter's throw. The construction also allows the darter to utilize standard shaft and main body portions with which they may be accustomed to thereby making it convenient and easy to use. It is thus seen that such a construction yields improved results from a significantly simpler and reliable construction.

It can readily be seen that the objects of the present invention are obtained with the structure described to provide a dart having anti-deflection apparatus contained therein. While the preferred embodiments of the present invention have been disclosed herein, it will be appreciated that modification of these particular embodiments of the invention may be resorted to without departing from the scope of the invention as found in the appended claims.

What is claimed is:

1. A game dart comprising anti-deflection means having as separable portions;

an elongated main body portion having a point coupled thereto, and protruding from said body portion;

a shaft portion including a section for retaining a flight;

a subassembly coupling said body portion to said shaft portion;

said subassembly including a housing having a longitudinal bore therein said bore having a reduced opening at one end;

a force applying means disposed within said bore;

a centering means acted on by said force applying means having an enlarged portion of a size greater than said reduced opening and a portion extending through said reduced opening coupled to said shaft portion.

2. A game dart as in claim 1, wherein;

said dart has a longitudinal axis, and said centering means is pivotable in any direction transverse to said axis.

3. A game dart as in claim 1, wherein;

said subassembly is coupled to said body and shaft portions by sections adapted to engage these portions, whereby the said body and shaft portions may be uncoupled from said subassembly for replacement or substitution.

4. A game dart as in claim 1, wherein;

said force applying means comprises a compression spring which is wholly enclosed within said bore of said housing.

5. A game dart as in claim 4, further comprising;

a bearing means disposed within said bore between said force applying means and said centering means, and being biased by said compression spring against said centering means within said bore.

6. A game dart as in claim 1, wherein;

said force applying means comprises an extension spring which is disposed within said bore of said housing.

7. A game dart as in claim 6, wherein;

said extension spring acts to bias said centering means toward said housing.

8. A game dart as in claim 1, wherein;

said centering means comprises a piston having a plate portion disposed and retained within said bore and having a shaft extending from said housing to be coupled with said shaft portion.

9. A game dart as in claim 8, wherein;

said plate portion is biased by said force applying means so as to keep the said piston aligned with an axis of said dart when no external forces are applied.

10. A game dart as in claim 1, wherein;

said shaft portion is capable of rotational and transverse motion such that obstruction to a position immediately adjacent said main body portion is avoided.

11. A game dart as in claim 1, wherein; said housing is tapered at one end thereof such that lateral movement of said shaft portion is facilitated.

12. A game dart as in claim 1, wherein;

said housing has a recess at one end thereof such that centering and lateral movement of said portion is facilitated.

13. A game dart as in claim 1, wherein;

said dart has a longitudinal axis, and said centering means is capable of rotation about said axis.

14. A game dart comprising;

a main body portion including a point to be embedded in a target;

a shaft portion including means to a retain a flight;

a subassembly coupling said body portion to said shaft portion;

said subassembly comprises a housing having a longitudinal bore therein said bore having a reduced opening at one end;

a force applying means disposed in said bore;

a centering means acted on by said force applying means having an enlarged portion of a size greater than said reduced opening and a portion extending through said reduced opening coupled with said shaft portion;

whereby said centering means is bias to a centered position by said force applying means and is capable of lateral and rotational movement.

* * * * *

UNITED STATES PATENT OFFICE

CERTIFICATE OF CORRECTION

Patent No. 4,858,927 Dated August 22, 1989

Inventor(s) Daniel E. Simmons

It is certified that error appears in the above-identified patent and that said Letters Patent is hereby corrected as shown below:

On the title page, in item [76], should read
--[76] Inventor: Daniel E. Simmons, 427 Seaman Ave., Akron, Ohio 44305--.

Signed and Sealed this

Twenty-second Day of January, 1991

*Attest:*

HARRY F. MANBECK, JR.

*Attesting Officer*

*Commissioner of Patents and Trademarks*